US010573990B2

(12) United States Patent
Sullivan

(10) Patent No.: US 10,573,990 B2
(45) Date of Patent: Feb. 25, 2020

(54) ELECTRICAL CONNECTOR WITH EXTERNAL LOAD BAR, AND METHOD OF ITS USE

(71) Applicant: Sullstar Technologies, Inc., Simi Valley, CA (US)

(72) Inventor: Robert W Sullivan, Simi Valley, CA (US)

(73) Assignee: Sullstar Technologies, Inc., Simi Valley, CA (US)

( * ) Notice: Subject to any disclaimer, the term of this patent is extended or adjusted under 35 U.S.C. 154(b) by 0 days.

(21) Appl. No.: 16/173,912

(22) Filed: Oct. 29, 2018

(65) Prior Publication Data

US 2019/0109403 A1 Apr. 11, 2019

Related U.S. Application Data

(63) Continuation of application No. 15/375,013, filed on Dec. 9, 2016, now Pat. No. 10,116,082, which is a (Continued)

(51) Int. Cl.
*H01R 13/04* (2006.01)
*H01R 13/46* (2006.01)

(Continued)

(52) U.S. Cl.
CPC ..... *H01R 13/46* (2013.01); *H01R 24/28* (2013.01); *H01R 24/64* (2013.01); *H01R 43/28* (2013.01); *H01R 2107/00* (2013.01)

(58) Field of Classification Search
CPC ..... H01R 13/46; H01R 24/28; H01R 24/64; H01R 43/28; H01R 2107/00

(Continued)

(56) References Cited

U.S. PATENT DOCUMENTS 3,998,514 A 12/1976 Hardesty
4,153,325 A 5/1979 Asick (Continued)

FOREIGN PATENT DOCUMENTS

CN 2418593 Y 2/2001
CN 201199559 Y 10/2002

(Continued)

OTHER PUBLICATIONS

European Patent Office (EPO); extended European Search Report (eESR) and Search Report (Search_Rpt) in English for corresponding EPC patent application No. 15 200 389.3, entitled Housing of an electrical connector with removable external load bar, and method of its use by Robert W. Sullivan, dated Jun. 6, 2016 from European Patent Office, 9 pgs.

(Continued)

*Primary Examiner* — Abdullah A Riyami
*Assistant Examiner* — Vladimir Imas
(74) *Attorney, Agent, or Firm* — Neal, Gerber & Eisenberg LLP

(57) ABSTRACT

An electrical connector, having an elongated plastic housing which is open at its rearward end and has an essentially continuous forward end wall with a flat upper portion, a lower portion of the forward end wall being integrally thickened to project forward beyond its upper portion.

16 Claims, 10 Drawing Sheets

Related U.S. Application Data continuation of application No. 14/120,730, filed on Jun. 23, 2014, now Pat. No. 9,543,729.

(60) Provisional application No. 61/959,189, filed on Aug. 19, 2013.

(51) Int. Cl.

| | |
|---|---|
| ***H01R 43/28*** | (2006.01) |
| ***H01R 24/64*** | (2011.01) |
| ***H01R 24/28*** | (2011.01) |
| *H01R 107/00* | (2006.01) |

(58) Field of Classification Search
USPC ..... 439/693
See application file for complete search history.

(56) References Cited

U.S. PATENT DOCUMENTS

| | | | | |
|---|---|---|---|---|
| 4,219,913 | A | 9/1980 | Johnson, Jr. | |
| 4,231,628 | A | 11/1980 | Hughes | |
| 4,444,447 | A | 4/1984 | Markwardt | |
| 4,444,448 | A | 4/1984 | Silbernagel | |
| 4,964,812 | A | 10/1990 | Siemon | |
| 5,147,215 | A | 9/1992 | Pritulsky | |
| 5,601,447 | A | 2/1997 | Reed | |
| 5,624,274 | A | 4/1997 | Lin | |
| 5,772,465 | A | 6/1998 | Hwang | |
| 5,803,770 | A | 9/1998 | Swedson | |
| 5,830,005 | A | 11/1998 | Watanabe | |
| 5,836,788 | A | 11/1998 | Torii | |
| 5,906,503 | A | 5/1999 | Wiencek | |
| 5,996,224 | A | 12/1999 | Sullivan | |
| 6,017,237 | A * | 1/2000 | Sullivan | H01R 43/01 439/392 |
| 6,080,007 | A | 6/2000 | Dupuis | |
| 6,105,229 | A * | 8/2000 | Sullivan | H01R 43/01 29/33 M |
| 6,116,943 | A | 9/2000 | Ferrill et al. | |
| 6,123,572 | A * | 9/2000 | Ishii | H01R 13/6463 439/418 |
| 6,162,077 | A * | 12/2000 | Laes | H01R 13/7032 439/188 |
| 6,217,344 | B1 | 4/2001 | Saito | |
| 6,238,231 | B1 | 5/2001 | Chapman | |
| 6,276,954 | B1 | 8/2001 | Arnett | |
| 6,371,775 | B1 | 4/2002 | Nakatsuka | |
| 6,402,559 | B1 * | 6/2002 | Marowsky | H01R 13/6463 439/460 |
| 6,416,363 | B1 | 7/2002 | Sumiyoshi | |
| 6,533,618 | B1 * | 3/2003 | Aekins | H05K 1/0228 439/676 |
| 6,663,436 | B1 | 12/2003 | Arnett | |
| 6,729,899 | B2 * | 5/2004 | Aekins | H01R 13/6463 439/404 |
| 6,729,901 | B2 * | 5/2004 | Aekins | H01R 13/6463 439/418 |
| 6,729,914 | B2 | 5/2004 | Jaouen | |
| 6,736,681 | B2 | 5/2004 | Arnett | |
| 6,746,283 | B2 | 6/2004 | Arnett | |
| 6,764,333 | B2 * | 7/2004 | Pocrass | H01R 9/035 439/418 |
| 6,783,402 | B2 | 8/2004 | Chen | |
| 6,821,142 | B1 | 11/2004 | Rayev | |
| 6,837,738 | B1 | 1/2005 | Chen | |
| 6,840,816 | B2 * | 1/2005 | Aekins | H05K 1/0228 439/676 |
| 6,905,359 | B2 | 6/2005 | Perkins | |
| 6,953,363 | B2 | 10/2005 | Kameyama | |
| 6,962,503 | B2 * | 11/2005 | Aekins | H01R 13/6463 439/418 |
| 7,168,992 | B2 | 1/2007 | Vo | |
| 7,241,162 | B1 | 7/2007 | Lawrence | |
| 7,381,083 | B2 * | 6/2008 | Amidon | H01R 4/2433 439/418 |
| 7,415,760 | B2 | 8/2008 | Elias | |
| 7,731,521 | B2 | 6/2010 | Corradi | |
| 7,857,635 | B2 * | 12/2010 | Goodrich | H01R 4/2412 439/344 |
| 7,972,183 | B1 * | 7/2011 | Lin | H01R 24/64 439/676 |
| 7,985,100 | B2 * | 7/2011 | Jaouen | H01R 24/64 439/676 |
| 7,985,101 | B2 | 7/2011 | Fitzpatrick | |
| 8,197,286 | B2 * | 6/2012 | Larsen | H01R 13/5833 439/620.21 |
| 8,708,754 | B2 * | 4/2014 | Su | G02B 6/3817 385/75 |
| 8,915,756 | B2 * | 12/2014 | Schumacher | H01R 13/6466 439/676 |
| 8,992,247 | B2 * | 3/2015 | Aekins | H01R 24/64 439/418 |
| 9,033,725 | B2 | 5/2015 | Fransen | |
| 9,054,460 | B2 * | 6/2015 | Schumacher | H01R 13/658 |
| 9,455,765 | B2 * | 9/2016 | Schumacher | H01R 13/6461 |
| 9,543,729 | B2 | 1/2017 | Sullivan | |
| 9,720,181 | B2 * | 8/2017 | Little | G02B 6/3817 |
| 10,116,082 | B2 | 10/2018 | Sullivan | |
| 2002/0142644 | A1 | 10/2002 | Aekins | |
| 2007/0113401 | A1 | 5/2007 | Elias | |
| 2008/0102686 | A1 | 5/2008 | Carreras | |
| 2008/0313897 | A1 | 12/2008 | Elias | |
| 2010/0297870 | A1 | 11/2010 | Stevens | |
| 2012/0282822 | A1 | 11/2012 | Elias | |
| 2013/0344722 | A1 | 12/2013 | Lloyd | |

FOREIGN PATENT DOCUMENTS

| | | | |
|---|---|---|---|
| CN | 2854844 | B1 | 1/2007 |
| CN | 201018150 | Y | 2/2008 |
| CN | 202196954 | U | 4/2012 |
| CN | 102714361 | | 10/2012 |
| EP | 0261285 | | 3/1988 |
| EP | 1875563 | B1 | 6/2009 |
| JP | H0628178 | B2 | 4/1994 |
| TW | 376594 | | 12/1999 |
| TW | 506167 | | 10/2002 |
| TW | 568403 | | 12/2003 |
| TW | M408172 | | 7/2011 |
| WO | 1986001646 | A1 | 3/1986 |
| WO | 1999/017406 | A1 | 4/1999 |

OTHER PUBLICATIONS

Taiwan Intellectual Proprty Office (TIPO); First Office Action (1OA) and Search Report (Search_Rpt) for corresponding TW patent application No. 104109823, entitled Electrical connector with removable external load bar, and method of its use by Robert W. Sullivan, dated Mar. 2, 2017 from Taiwan Intellectual Property Office, 3 pgs.

China National Intellectual Proprty Adnimistration (CNIPA); First Office Action (1OA) and Search Report (Search_Rpt) for corresponding CN patent application No. 201710679180.4, entitled Electrical connector with removable external load bar, and method of its use by Robert W. Sullivan, dated Nov. 30, 2018 from China Intellectual Property Administration, 7 pgs.

China National Intellectual Proprty Adnimistration (CNIPA); First Office Action (1OA) and Search Report (Search_Rpt) for corresponding CN patent application No. 201810109054.X, entitled Electrical connector with removable external load bar, and method of its use by Robert W. Sullivan, dated Feb. 15, 2019 from China Intellectual Property Administration, 4 pgs.

European Patent Office (EPO); First Office Action (1OA) in corresponding EPC patent application No. 15 200 389.3, entitled Housing of an electrical connector with removable external load bar, and method of its use by Robert W. Sullivan, dated Jan. 30, 2019 from European Patent Office, 5 pgs.

(56) References Cited

OTHER PUBLICATIONS

European Patent Office (EPO); First Office Action (1OA) IN corresponding EPC patent application No. 17 186 799.7 entitled Housing of an electrical connector with removable external load bar, and method of its use by Robert W. Sullivan, dated Nov. 28, 2018 from European Patent Office, 8 pgs.

Taiwan Intellectual Proprty Office (TIPO); First Office Action (1OA) and Search Report (Search_Rpt) for corresponding TW patent application No. 106141231, entitled Electrical connector with removable external load bar, and method of its use by Robert W. Sullivan, dated May 25, 2018 from Taiwan Intellectual Property Office, 3 pgs.

Taiwan Intellectual Property Office (TIPO); First Office Action (1OA) in English for corresponding patent application No. 107136349, entitled Electrical connector with removable external load bar, and method of its use by Robert W. Sullivan, dated May 9, 2019 from Taiwan Intellectual Property Office, 6 pgs.

Taiwan Intellectual Property Office (TIPO); Search Report (Search_Rpt) in English for corresponding patent application No. 107136349, entitled Electrical connector with removable external load bar, and method of its use by Robert W. Sullivan, dated May 8, 2019 from Taiwan Intellectual Property Office, 1pg.

* cited by examiner

ELECTRICAL CONNECTOR WITH EXTERNAL LOAD BAR, AND METHOD OF ITS USE

This application is a continuation of pending U.S. Nonprovisional application Ser. No. 15/375,013, filed Dec. 9, 2016, which is herein incorporated by reference in its entirety, which is a continuation of U.S. Nonprovisional application Ser. No. 14/120,730, filed Jun. 23, 2014, issued as U.S. Pat. No. 9,543,729, which claims the benefit of U.S. Provisional Application No. 61/959,189, filed Aug. 19, 2013.

PRIOR ART

This application describes and claims improvements over the inventions shown in my previously issued U.S. Pat. No. 6,017,237, as well as U.S. Pat. Nos. 5,996,224 and 6,105,229. The product patented there is a male type RJ45 connector, into which eight wires from a cable are inserted, and associated crimping and shearing tool. When the connector housing is crimped to secure the internal position of the wires, its internally contained electrical contact blades also assume the positions in which they will matingly engage the blades of corresponding contacts in the receptacle of an associated female RJ45 connector. For more than the past decade the eight-wire connector system disclosed in my referenced patents has been sold under my trademark EZ-RJ45 and used in Ethernet cable systems throughout the world. The uniqueness and novelty of these items has not been challenged.

One important feature of the inventions shown in those patents is that the wires are arranged inside the connector in such a way as to minimize interference or cross-talk between data streams being transmitted on respective wire pairs. Another important feature is the method in which color-coded wires inserted into the connector are allowed to protrude out from its front end so that a technician may view the color coded wires to verify their correct relative positions before shearing off their protruding ends. A further feature of those inventions is the arrangement of the connector assembly and its associated crimping and shearing tool such that the driven engagement of metallic contacts into the wires inside the connector housing, and the shearing and cutting off of the protruding wire ends, is done concurrently with the crimping of the plastic connector to secure the wires in their places inside the connector.

As electrical components for high-speed data transmission are made smaller and smaller, the data rates, packets, frequencies, and speed increase, and the corresponding wires get larger and larger, it has become necessary to establish rigorous standards to ensure their proper performance. Precise configurations and dimensions are required by FCC regulations and other industry standards. A connector housing must be made of a moldable injected material which is sufficiently moldable and deformable, such as GE Lexan material, to capture and retain the wires inside it. At the same time, the housing must have sufficient rigidity to reliably support the wires and their associated contact blades in precisely correct positions, in order to mate with associated contact elements in the receptacle of a female RJ45 connector. A further requirement is that the moldable material utilized must meet a fire safety standard of the Underwriters Laboratory and other international physical, electrical, quality and performance testing standards.

Drawings of my previous patents show many important details of my EZ-RJ45 connector as it has been and is presently being sold, those figures being identical in all three of my three prior patents. For convenient reference, certain figures of my prior patents are reproduced here as follows:

| This Application | Pat. No. 6,017,237 |
|---|---|
| FIG. 1 | FIG. 8 |
| FIG. 2 | FIG. 9 |
| FIG. 3 | FIG. 5 |
| FIG. 4 | FIG. 6 |

There are also other important details shown in drawings of my prior patent that are not fully replicated here, but understood.

Connector 20 as shown in FIG. 5 of my prior patents (reproduced here as FIG. 3) has an elongated hollow plastic housing 22. Insulated wires 16 enter its open rearward end 24 and extend in guided pathways inside and through the housing. Within the housing metal contact plates 36 having sharpened lower ends are poised to pierce the insulation of and make firm electrical contact with corresponding wires. The upper jaw 50 of an associated crimping and shearing tool has a downward protrusion 56 that will drive the metal contact plates 36 down into the correct position for their forward edges to matingly engage corresponding contacts, not shown, in the receptacle of the female RJ45 connector. The ends of wires 16 will not engage any contacts in female receptacle.

As shown in FIG. 4 of this application [FIG. 6 of my prior patents] the crimping and shearing tool has a lower jaw 70 which provides support underneath the housing 22 during a crimping and shearing operation. FIGS. 1 and 2 of this application show a control tab 30 which extends lengthwise underneath the housing 22. The forward end of of control tab 30 must meet shape and dimension standards prescribed by FCC standards in order to correctly position the connector within the receptacle of a female connector (not shown). The outer end portion of the control tab 30 also provides a small anvil 42 at the forward end of housing 22 against which six of the protruding wire ends are sheared and cut when the crimping and shearing tool 50 is pressed downward.

In my EZ-RJ45 as shown in my previous patents the front end wall of housing 22 is largely closed but has openings 42 for the eight wires to protrude. There are also slots or grooves in the front end wall that are partially occupied by the contact blades 36, but the lateral edges of the blades 36 at the forward end of the housing do not extend to the front face of the housing. Instead, they are recessed back from the front end surface. This is necessary to allow the contact blades of a female receptacle (not shown) to be guided into those slots or grooves for making face-to-face contact with the lateral edges of contact blades 36. The mating contacts of the female receptacle (not shown) are protruding contact blades which will enter those slots or grooves to complete the electrical circuitry of the connector. The bared ends of wires 16 after they are cut do not engage any contacts in the female connector.

When tool 50, 70, is actuated for the crimping and shearing operation its cutting blade 60 wipes the front end of housing 22. In my EZ-RJ45 connector as shown in my prior patents six of the eight protruding wires 16—wires numbers 2 through 7—are freely floating over the anvil 42 and are reliably cut off in concert by the crimping and shearing tool 50, 70. The reason for this is that the connector control tab 30 must have exactly correct dimensions in order to precisely fit within a receptacle whose shape and dimensions are prescribed by an FCC or industry standard. The control tab 30 is wide enough to provide a supporting anvil only for wires 2-7. It has therefore been a practice in the field for the technicians using my EZ-RJ45 system to finish cutting off the ends of wires 1 and 8 by hand, after the connector housing has been crimped and the other wires have already been cut off. The wires used in my EZ-RJ45 connector are typically of the AWG size 24 in CAT 5 cable, with a proven data transmission rate per respective standards.

As shown in my prior patents, openings 44 through which the eight wires 16 will protrude are in a lower portion of the forward end face of housing 20. The slots or grooves for the contact blades are in the upper area of the front end wall of connector housing 20, and there is a vertical separation between the horizontal row of openings 44 for the wires and the slots or grooves for the contact blades 36.

PRIOR ART also includes Taiwan Patent No. CN2854844Y, U.S. Pat. No. 5,601,447 issued in 1997, and U.S. Pat. No. 6,905,359 issued in 2005.

BACKGROUND OF THE PRESENT INVENTION

It is necessary for the contact blades, not shown, of a female RJ45 connector to precisely mate with the forward edges of contact blades 36. The field experience and complaints with my EZ-RJ45 connector system have shown a need for improved performance. The operation of the shearing and crimping tool 50, 70, often tends to cause a distortion in the plastic housing 20, so that the wires and contacts are not maintained precisely in their desired dimensionally stable positions. There are several different forces that contribute to this result:

1. sliding contact force overcoming friction for seating blades 36;
2. insulation displacement force IDC. This is the force it takes to push the gold connector contact blades 36 into the wire insulation plastic coating and mate with the copper wires.
3. cut wire force—the shearing force needed to cut the wires 2-7;
4. any dullness of the cutting blade exacerbates the problem.
5. since the blade 60 as shown in my prior patents is free-floating, any misalignment of the blade also exacerbates the problem.

All of these forces tend to push, twist, and deform the connector housing in an undesired manner. This may lead to an FCC non-compliant connector that has to be discarded, causing loss of time and money.

Since my present product requires hand cutting of wires 1 and 8, it would also be desirable to have all eight of the wires cut and sheared by the crimping and shearing tool, to avoid an extra hand working step by the technician.

SUMMARY OF THE PRESENT INVENTION

The first main concept of my present invention is using wires having thicker insulation, of AWG size 23, and keeping each twisted pair in its twisted state as close as possible to the pair of metal contacts that will conductively engage its respective wires, in order to improve the electrical performance and data transmission rate of the connector.

A second main concept of my invention is to provide a thickened front end wall (External Load Bar, or Stiffener). The outer dimensions of the connector housing must be limited to comply with legal and industry standards, and the larger wires necessarily require a reduction in the amount of plastic material forming the connector housing. The External Load Bar (or Stiffener) mechanically supports both the connector housing and the wires it contains, and is then sheared off along with the protruding wire ends in order to allow the male connector to properly mate with an associated female connector.

A third main feature of my present invention is a method which not only allows the outer ends of the protruding wire pairs to project from the front of the connector for color comparison purposes, but also allows the wires to be pulled and tightened in their still-twisted condition and brought as close as possible to their respectively associated contact blades before being sheared off. This method helps to improve the quality of electrical performance and to increase the data transmission rate.

According to my present invention, holes for the protruding wires, as well as slots or grooves for the contact blades, are provided in the thickened front end wall in generally the same way as shown in my prior parents. However, the thickened portion of the front wall (External Load Bar), which does include the area where the horizontal openings for the protruding wires are formed, does not include the slots or grooves that will receive the contact blades of a female receptacle.

When the modified crimping and shearing tool of my new invention cuts off the protruding ends of the wires it simultaneously shears off the unwanted thickness of the front end wall (External Load Bar or Stiffener). The Stiffener or Load Bar is formed INTEGRAL WITH the forward end wall of the housing. Therefore, when the blade acts to cut off the STIFFENER or LOAD BAR, that Stiffener or Load Bar continues to provide a stabilizing support for the front end wall of the housing UNTIL THE ACTION OF THE CUTTING BLADE IS FULLY COMPLETED and the Stiffener or load Bar has become fully severed from the connector housing.

With this thickened or stiffener portion of the front end wall, the housing 22 better supports both the wires, and the slots or grooves for receiving the contacts blades, before, during, and after the wires are cut off.

Thus in shearing off the exposed ends of the wires, I now at the same time cut off the thickened or stiffener part of the end wall, still leaving a thin front end wall for the connector housing that is sufficient to maintain the correct spatial locations of both the wires 16 and the contact blades 36. The connector then fits correctly within its allotted space in an associated female receptacle or terminal board.

In other words, by thickening the front end wall of housing 22, I now make the connector initially too long to fit within its prescribed space in a receptacle or panel board. But by cutting off the excess thickness of the front wall while the connector housing is being crimped and the contacts 36 are being forced into their conductive engagement with the associated wires 16, I reduce the connector housing length so that it does correctly fit, and also improves the end result of correctly terminating the connector.

I provide horizontal guideways inside the connector housing 22 to permit two horizontal rows of four wires each, in a staggered relationship, to be inserted into and through the connector. The holes or openings in the front end wall of housing 22 are then in two separate rows, four in each row. Adjacent holes then tend to slightly overlap or merge into each other.

Another and related feature of my present invention is modifying the crimping and shearing tool so that it very positively cuts off all the protruding wire ends concurrent with the crimping operation. I accomplish this by adding a pair of short posts to the lateral ends of the lower jaw 70 of crimping tool 50, 70. These posts together with the control tab 30 then provide an expanded and adequate anvil surface 42 for cutting off all of the wire ends that are encased in plasic; first the four in the upper horizontal row, and then the four in the lower horizontal row.

A still further feature of the present invention is that I also provide a set of guides to control downward movement of the cutting blade, and a groove extending laterally across the upper surface of the External Load Bar adjacent to the front wall of the connector housing, to guide the edge of cutting blade 60 when the blade is pushed down in its cutting action.

The objective of these improvements is to provide a connector that is suitable for use with CAT 6, CAT 6A and other ethernet cable and future larger wires and standards, in order to reliably operate at a data transmission rate of ten gigahertz and future transmission rates and applications.

DRAWING SUMMARY

Figure 9:
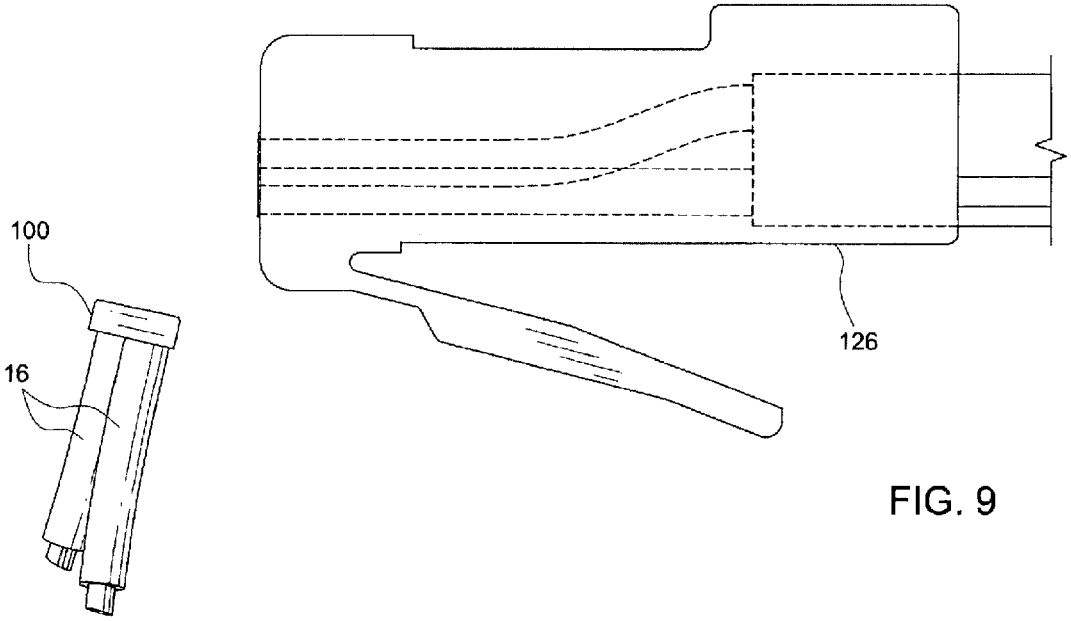
Figure 10:
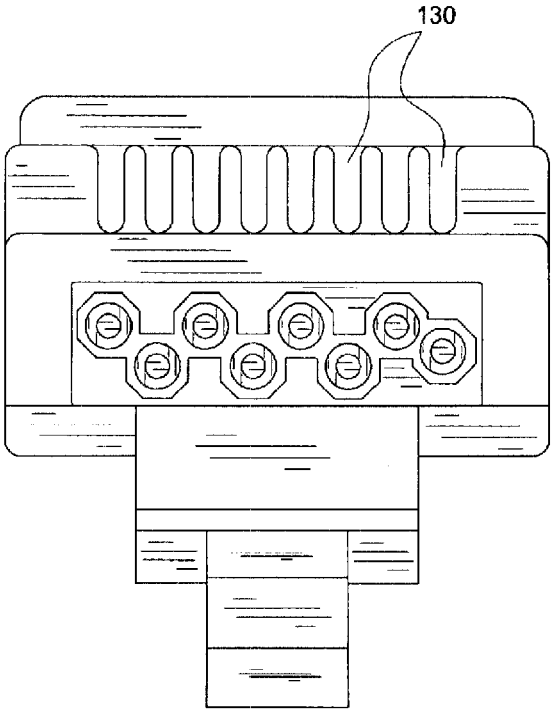

FIG. 9 is a side elevational view showing the External Load Bar after it has been separated from the connector housing, and still retains its accompanying load of the insulated wires which still remain encased in it and protrude from it; and FIG. 10 is a front end elevation of the loaded connector housing after the External Load Bar has been shorn off, exposing the bare ends of the insulated wires.

DETAILED DESCRIPTION

Figure 1:
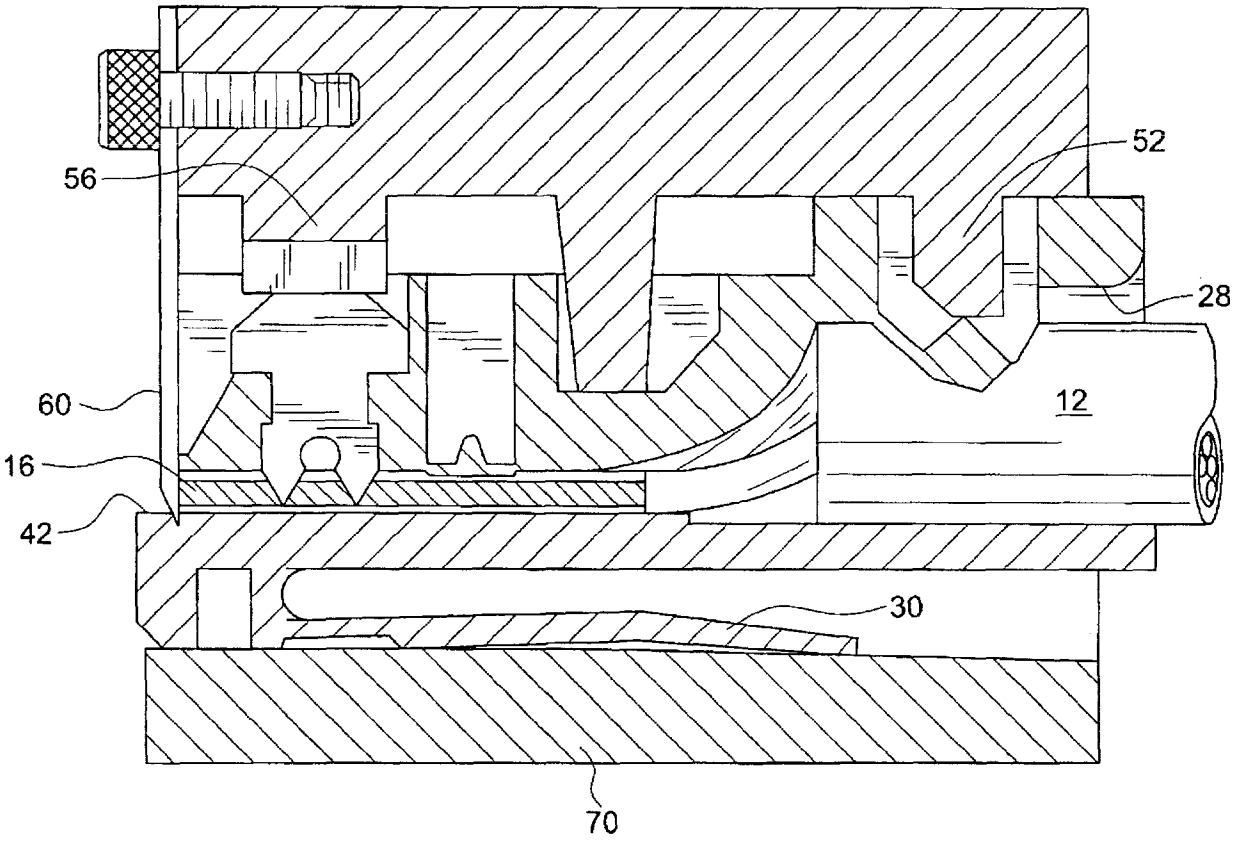
FIG. 1 Prior Art
FIGS. 1 through 4 are provided as exact copies of certain figures in my prior patents, which is necessary in order to provide a proper basis for describing my present invention.
Figure 2:
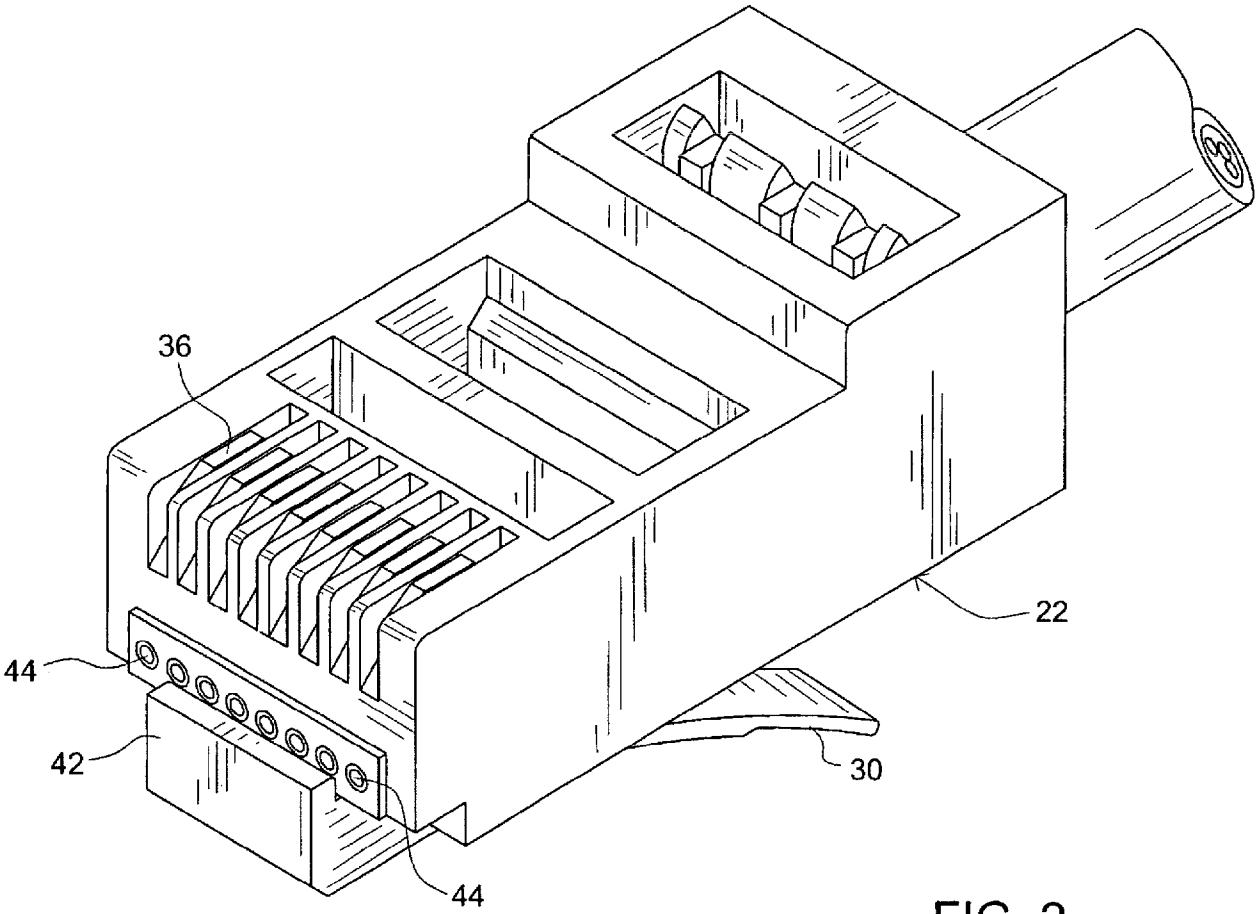
FIG. 2 Prior Art
Figure 3:
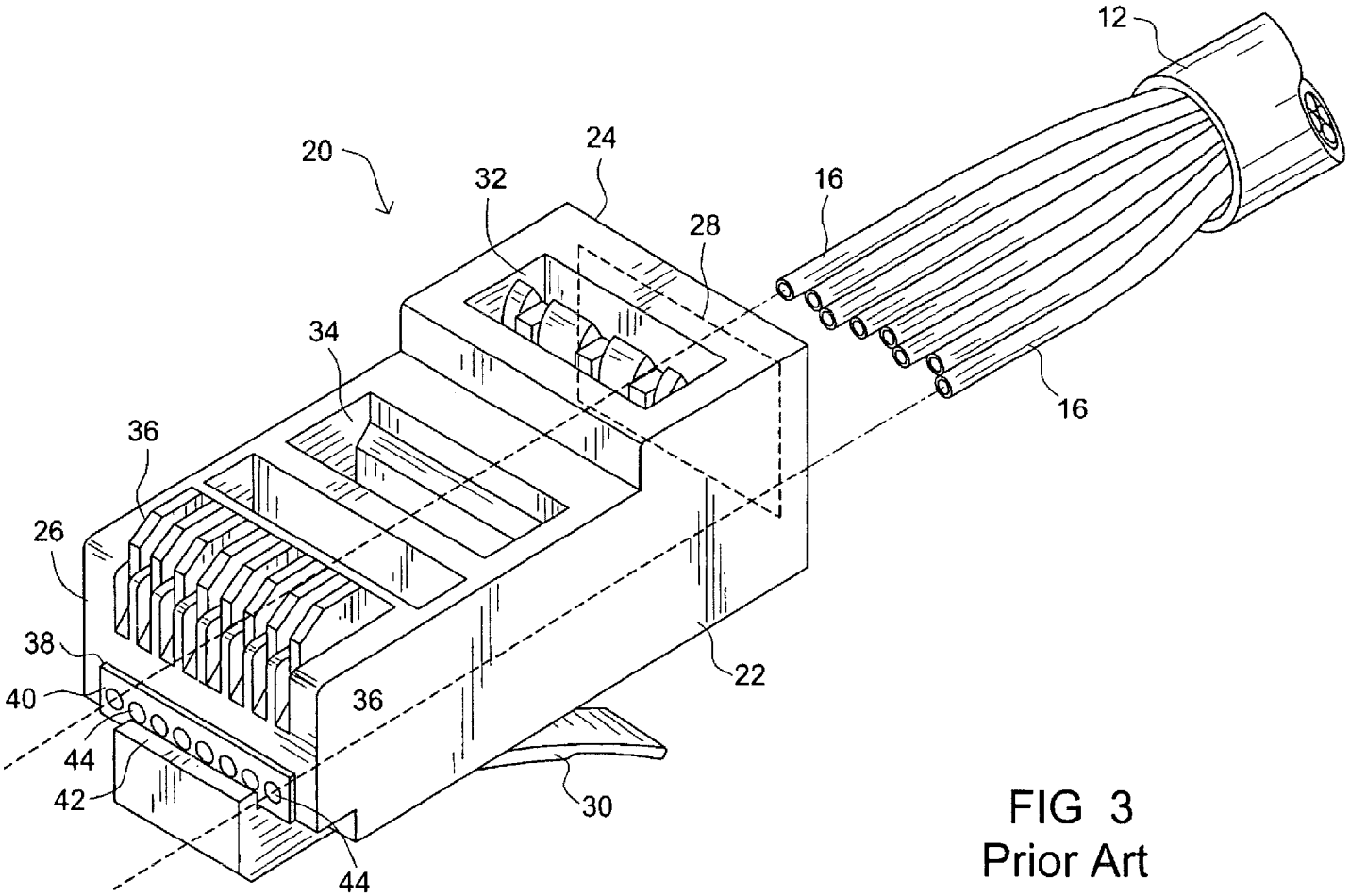
FIG 3 Prior Art
Figure 4:
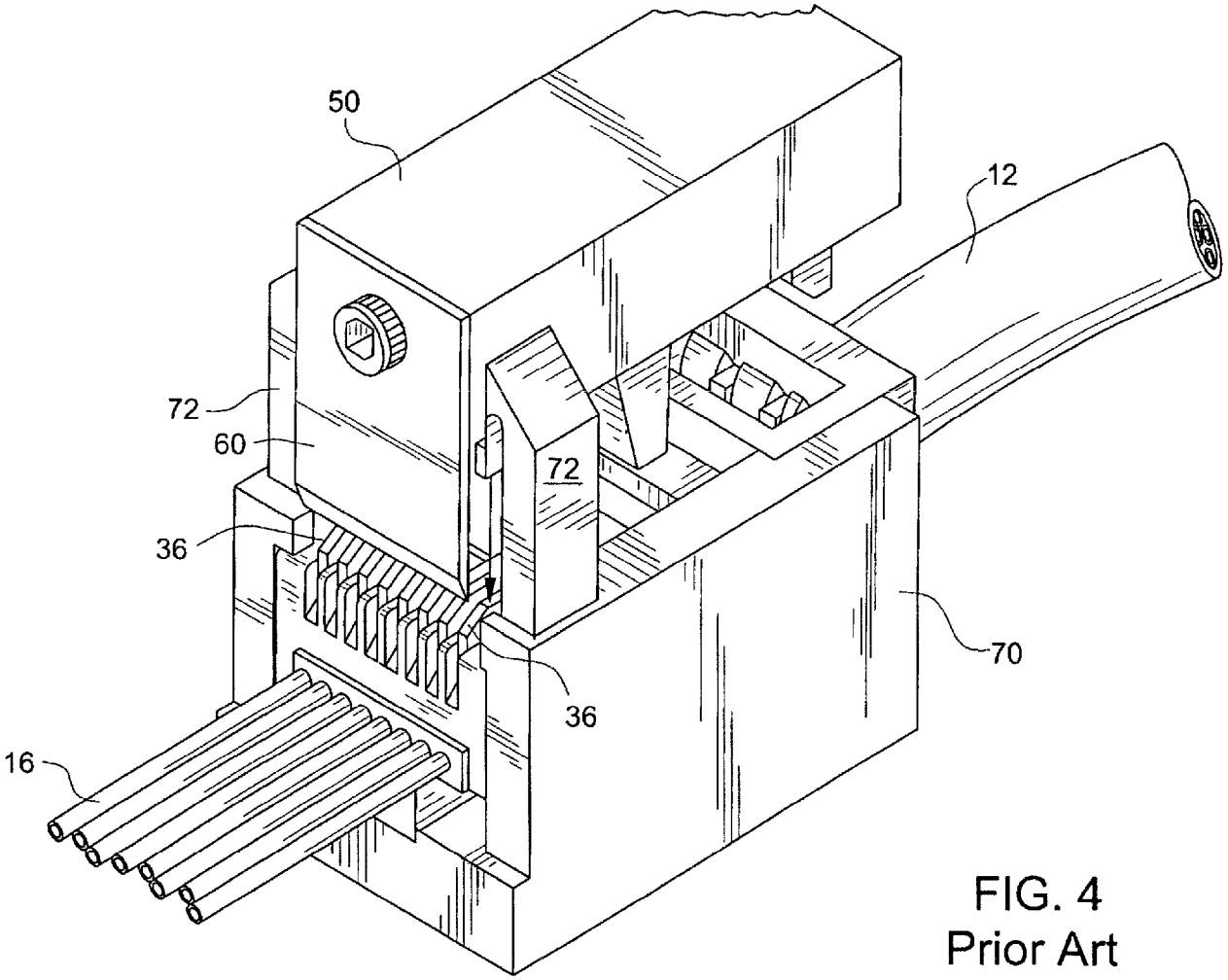
FIG. 4 Prior Art
Figure 5:
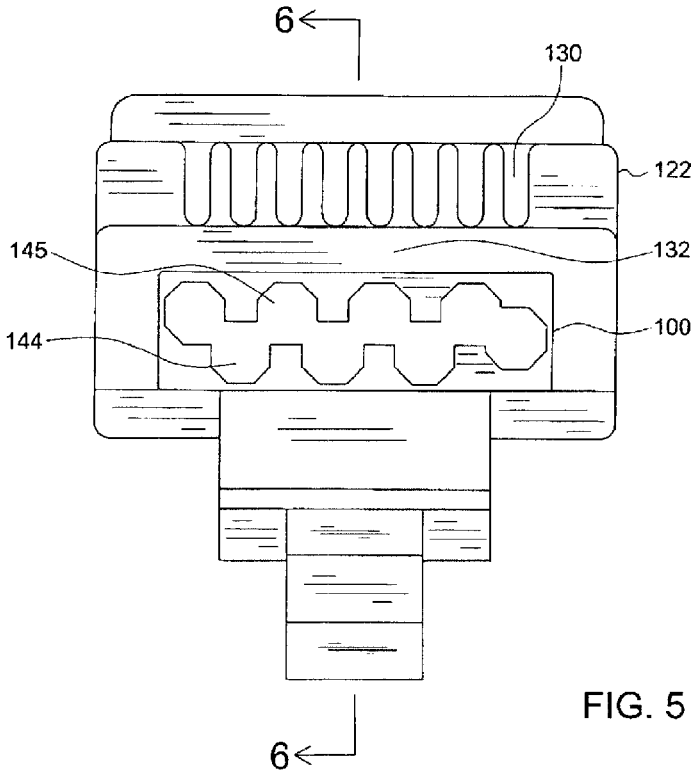
FIG. 5 is a front end elevation view of my modified connector housing and External Load Bar, showing the empty connector not loaded with wires.
Figure 6:
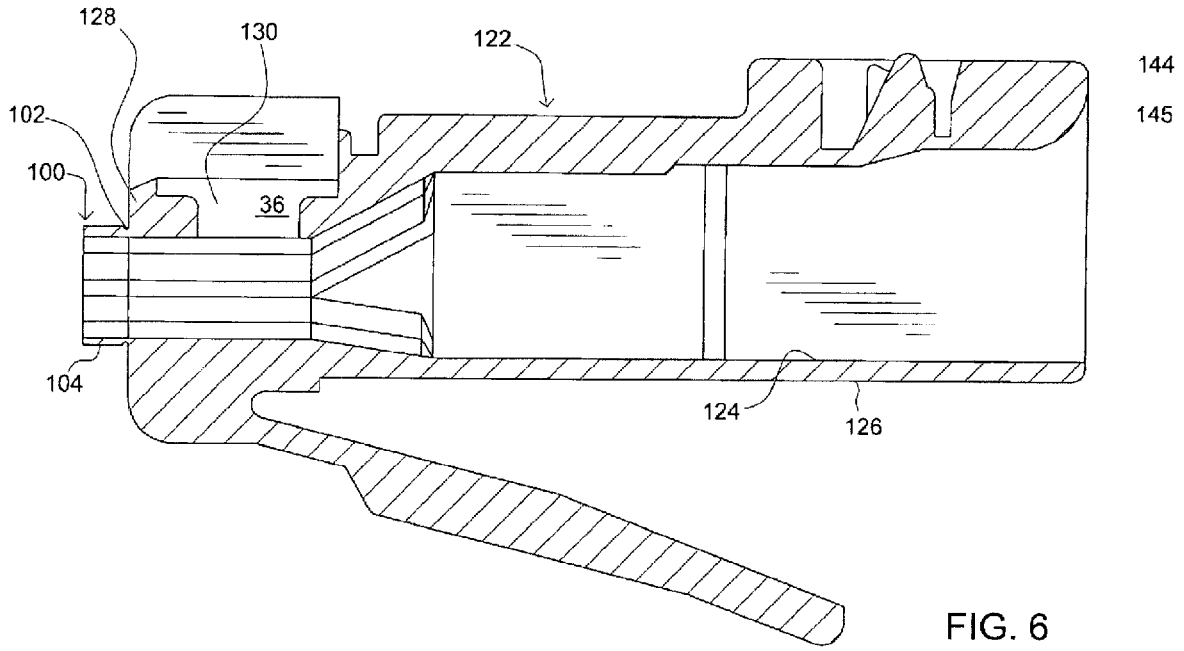
FIG. 6 is an elevational cross-section taken on Line 6-6 of FIG. 5 showing the empty connector housing with the External Load Bar on its forward end wall.

As shown in FIGS. 5 and 6, the modified connector housing 122 has a thickened Stiffener 100 (otherwise known as the External Load Bar) formed as an integral lower part of its front end wall 128. A horizontal row of four upper holes 145 and a horizontal row of four lower holes 144 are formed through the solid material of the Stiffener. As best seen in FIG. 5, the holes of the rows are staggered, and tend to blend or merge together. Stiffener 100 has a flat bottom surface identified by numeral 104. During the shearing operation, stiffener 100 will be supported from that bottom surface 104, which will in turn rest upon an anvil. There is a thin layer of plastic material underneath the lower holes 144, which forms the bottom surface 104.

On the front wall of housing 122 as best seen in FIG. 5, there is an upper vertical area 132, above the Stiffener 100, where the slots or grooves 130 for contact blades 36 are located. There are eight of these slots to accommodate the eight contact plates 36. The cross-section view of FIG. 6 shows one contact blade 36 occupying the corresponding slot or groove 130.

As shown in FIG. 6, the bottom wall of connector housing 122 is designated 124 and its bottom surface as 126. When the connector is loaded with wires, they will be in suitable guideways extending the length of the hollow connector housing, and will also extend through the holes 144, 145, and protrude outward from the front side of the Stiffener 100.

Since FIG. 6 is a cross-section view, it shows one of the contact blades 36 occupying a corresponding one of the slots 130.

As also indicated in FIG. 6, the plastic material of Stiffener 100 is formed integral with front end wall 128 of housing 122. That is extremely important, because when the Stiffener 100 and the encased wires it contains are sheared off, the Stiffener continues to mechanically support the front end wall 128 until the shearing is fully complete.

As shown in FIG. 6, the upper surface of Stiffener 100 has a small groove 102 that is immediately adjacent the flat upper face 132 of the connector housing. The purpose of that groove is to guide the action of cutting blade 60 when the stiffener and wire ends are to be sheared off.

Figure 7:
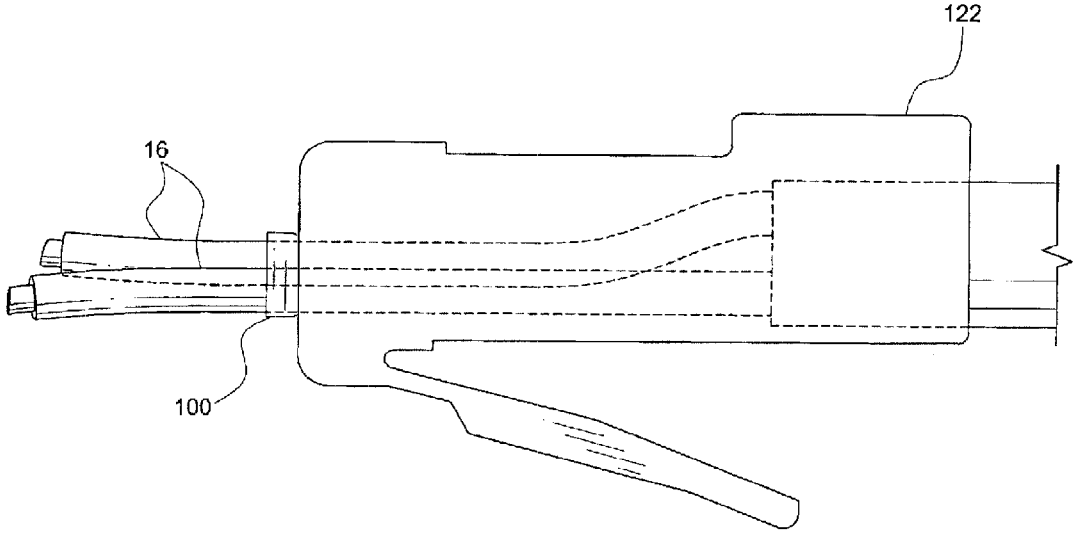
FIG. 7 is a side elevational view of the connector housing loaded with wires.

Reference is now made to FIG. 7 which shows the connector housing when loaded with insulated wires. Wires 16 are unsheathed from an incoming cable with a length sufficient to protrude at least several inches of gripping length from the front side of Stiffener 100. This allows the technician to pull the wires tight before doing the crimping and shearing operation. Tightness of the wires inside the connector housing improves the electrical performance of the connector.

Figure 8:
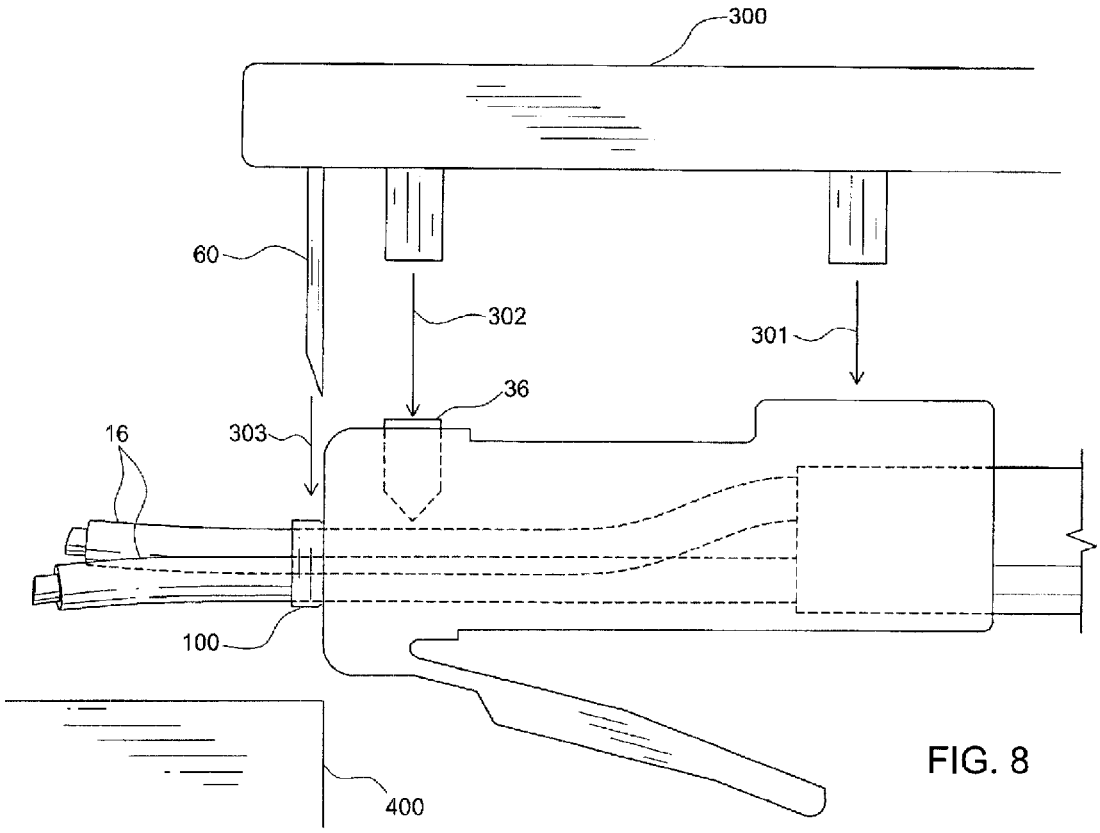
FIG. 8 is a view like FIG. 7, but additionally with schematic indications showing how the crimping and shearing operation, and the separation of the External Load Bar with its encased wires, will be done.

FIG. 8 reproduces the loaded housing of FIG. 7 on a smaller scale, to provide space to schematically illustrate how the crimping and shearing will be done. A hand tool 300 above the housing drives arrows 301, 302, and 303 downward. Arrow 301 represents the crimping of the plastic housing, in the manner shown in my prior patents. Arrow 302 represents the blade driver, that drives all of the blades 36 into electrical engagement with the corresponding contact blades. And arrow 303 represents the cutting blade 60 that will shear off both the Stiffener 100 and its encased wires. A block 42 shown in the lower left corner of the drawing represents an anvil that supports the bottom surface 104 of the Stiffener 100, and that the blade 60 will engage at the end of its cutting stroke.

As shown in FIG. 9, the Stiffener 100 after separation from front wall 128 of the housing still retains its load of insulated wires 16 protruding from its front side. It is then no longer needed, and may be disposed of.

As shown in FIG. 10, removal of the Stiffener 100 has left the bare front wall 128 in which the bared ends of the insulated wires are clearly visible. The wire ends do not and must not protrude, or there would be a risk of electrical engagement with the female connector. To accomplish the appropriate electrical function of the connector, that must not be tolerated. Removal of the Stiffener brings the size and shape of the housing 122 back to the industry and FCC standard, so as to correctly mate with a female RJ45 connector.

Method of Operation

As described above, the modified connector housing of the present invention is made with the Stiffener or External Load Bar as an integrally formed part of it. Four pairs of insulated wires are inserted into and through the housing 122, and through the upper and lower holes 144, 145, in the Stiffener. The manner of guiding the wire pairs is such that one wire of each pair protrudes through an upper hole 145, and the other wire of each pair protrudes through the adjacent lower hole 144.

Before shearing the Stiffener and encased wire ends the technician will check the color coding of the wires to verify their correct locations. He then preferably stretches each of the wire pairs by pulling its protruding ends. The purpose of that is to bring each wire pair, inside the connector, as close as possible to the respectively associated contact blades. This is essential to maximize the electrical performance of the connector.

I have modified my crimping and shearing tool 50, 70, to provide two small posts that extend the ends of anvil 42, so that all eight of the wires will be cut in a single pass of the cutting blade 60. The Stiffener sits directly on the anvil, with no space between its bottom surface and the anvil. There is a measurable thickness of plastic material below the bottom row of holes. When the shearing takes place, the blade 60 first cuts all of the wires in the upper row 145, and then all wires in the lower row 144.

After the shearing is done the Stiffener—which is now detached from the front wall 128—may be disposed of Connector housing 122 is then moved into mating engagement with an associated female receptacle, bringing the contact prongs of the female receptacle into engagement with the contact blades 36. Performance tests, if necessary or desired, may then be conducted.

Although I have described my invention in detail in order to comply with requirements of the patent laws, it will be understood that the scope of my protection is to be adjudged only in accordance with the appended claims.

What is claimed is:

1. An electrical connector comprising:

a housing having a first end and a second end, with a channel extending from an opening in the second end towards a wall of the front end;

an extension portion extending from the wall of the front end, with the wall of the front end including a plurality of holes arranged in rows that extend through the wall of the front end to the channel with the extension portion being positioned below the lowermost row of the rows and with the extension portion being sized to accommodate posts on a cutting tool with the posts being positioned on opposing sides of the extension portion with a top surface of each post being co-planer with a top surface of the extension portion in a cutting position such that the extension portion and posts act as a cutting surface for a blade that shears each wire extending through each hole;

wherein, the channel is sized to accommodate a cable including a plurality of wires with each wire engaging a corresponding hole in the wall of the front end.

2. The electrical connector of claim 1, wherein the extension portion includes a guide groove adjacent to a flat upper portion of the channel.

3. The electrical connector of claim 1, further comprising at least one contact blade groove in a top surface of the extension portion.

4. The electrical connector of claim 3, wherein the extension portion includes the top surface, a bottom surface and two parallel side surfaces between the top surface and bottom surface.

5. The electrical connector of claim 1, wherein the holes are arranged in a staggered pattern.

6. The electrical connector of claim 1 wherein the holes are aligned in a single row.

7. The electrical connector of claim 1, wherein the wires extend beyond the extension portion.

8. The electrical connector of claim 1, including a plurality of contacts that engage a corresponding wire where a size of each contact is different from a size of an adjacent contact.

9. A method of preparing an electrical connector, the method comprising the steps of:

forming a housing having a first end and a second end, with a channel extending from an opening in the second end towards a wall of the front end;

forming an extension portion extending from the wall of the front end, with the wall of the front end including a plurality of holes arranged in rows that extend through the wall of the front end to the channel with the extension portion being positioned below the lowermost row of the rows and with the extension portion being sized to accommodate posts on a cutting tool with the posts being positioned on opposing sides of the extension portion with a top surface of each post being co-planer with a top surface of the extension portion in a cutting position such that the extension portion and posts act as a cutting surface for a blade that shears a wire extending through each hole;

wherein, the channel is sized to accommodate a cable including a plurality of wires with each wire engaging a corresponding hole in the extension portion.

10. The method of claim 9, including the step of forming a guide groove adjacent to the flat upper portion in the extension portion.

11. The method of claim 9, including the step of forming at least one contact blade groove in the forward end wall.

12. The method of claim 11, wherein the extension portion includes a top surface, a bottom surface and two parallel side surfaces between the top surface and bottom surface.

13. The method of claim 9, wherein the holes are arranged in a staggered pattern.

14. The method of claim 9, wherein the holes are aligned in a single row.

15. The method of claim 9, wherein the wires extend beyond the extension portion.

16. An electrical connector comprising:

a housing having a first end and a second end, with a channel extending from an opening in the second end towards a wall of the front end;

an extension portion extending from the wall of the front end, with the wall of the front end including a plurality of holes that extend through the wall of the front end to the channel, with the extension portion being positioned below the holes and with the extension portion being sized to accommodate posts on a cutting tool with the posts being positioned on opposing sides of the extension portion with a top surface of each post being co-planer with a top surface of the extension portion in a cutting position such that the extension portion extends below each of the holes such that the extension portion acts as a cutting surface for a blade that shears a wire extending through each hole;

wherein, the channel is sized to accommodate a cable including a plurality of wires with each wire engaging a corresponding hole in the wall of the front end.

* * * * *